US010561289B2

(12) United States Patent
Hu et al.

(10) Patent No.: US 10,561,289 B2
(45) Date of Patent: Feb. 18, 2020

(54) DUST COLLECTION BOX AND ROBOT VACUUM CLEANER

(71) Applicants: JIANGSU MIDEA CLEANING APPLIANCES CO., LTD., Suzhou (CN); MIDEA GROUP CO., LTD., Foshan (CN)

(72) Inventors: Wei Hu, Suzhou (CN); Xianmin Wei, Suzhou (CN); Manzhi Jin, Suzhou (CN)

( * ) Notice: Subject to any disclaimer, the term of this patent is extended or adjusted under 35 U.S.C. 154(b) by 0 days.

(21) Appl. No.: 16/130,991

(22) Filed: Sep. 13, 2018

(65) Prior Publication Data

US 2019/0298127 A1 Oct. 3, 2019

Related U.S. Application Data

(63) Continuation of application No. PCT/CN2018/098029, filed on Aug. 1, 2018.

(30) Foreign Application Priority Data

Mar. 30, 2018 (CN) ..... 2018 2 0465545 U

(51) Int. Cl.

| | |
|---|---|
| ***A47L 9/10*** | (2006.01) |
| ***A47L 9/14*** | (2006.01) |
| *A47L 11/40* | (2006.01) |

(52) U.S. Cl.

CPC ..... *A47L 9/1409* (2013.01); *A47L 9/102* (2013.01); *A47L 9/106* (2013.01); *A47L 9/149* (2013.01);

(Continued)

(58) Field of Classification Search

CPC .....
A47L 11/4027; A47L 11/403; A47L 11/4033; A47L 9/10

See application file for complete search history.

(56) References Cited

U.S. PATENT DOCUMENTS 4,466,155 A * 8/1984 Grave ..... A47L 11/30 15/321
5,794,297 A * 8/1998 Muta ..... A47L 11/33 15/41.1

(Continued)

FOREIGN PATENT DOCUMENTS

CN 1496702 A 5/2004
CN 101273860 A 10/2008

(Continued)

OTHER PUBLICATIONS

International Search Report dated Dec. 26, 2018 in the corresponding PCT application(application No. PCT/CN2018/098029).

*Primary Examiner* — Michael D Jennings
(74) *Attorney, Agent, or Firm* — Kilpatrick Townsend & Stockton, LLP

(57) ABSTRACT

A dust collection box and a robot vacuum cleaner are disclosed. The dust collection box is used in the robot vacuum cleaner. The dust collection box includes a box body, a filter holder arranged in the box body, a dust separation structure configured to block dust, and a filter. The box body defines an air inlet and an air outlet. The filter holder defines an opening in a side surface thereof. The dust separation structure is arranged in the box body and located at an air inlet side of the opening. The filter is arranged to the filter holder and located at an air outlet side of the opening.

8 Claims, 6 Drawing Sheets

(52) U.S. Cl.
CPC ..... *A47L 9/1463* (2013.01); *A47L 11/40* (2013.01); *A47L 2201/00* (2013.01)

(56) References Cited

U.S. PATENT DOCUMENTS

| | | | | |
|---|---|---|---|---|
| 2003/0066274 | A1* | 4/2003 | Fredrick | B01D 46/0004 55/496 |
| 2019/0038106 | A1* | 2/2019 | Jang | A47L 11/4061 |

FOREIGN PATENT DOCUMENTS

| | | | |
|---|---|---|---|
| CN | 203693491 | U | 7/2014 |
| CN | 203943625 | U | 11/2014 |
| CN | 204105894 | U | 1/2015 |
| CN | 204841212 | A | 12/2015 |
| CN | 105491930 | A | 4/2016 |
| CN | 206261556 | U | 6/2017 |
| JP | 2011056156 | A | 3/2011 |

* cited by examiner

DUST COLLECTION BOX AND ROBOT VACUUM CLEANER

PRIORITY

This application is a continuation of International Application No. PCT/CN2018/098029, filed on Aug. 1, 2018, which claims priority to and the benefit of Chinese Patent Application No. 201820465545.3 filed in the China's State Intellectual Property Office on Mar. 30, 2018, the entire contents of which are incorporated herein by reference.

FIELD

The present disclosure relates to a technical field of household appliances, and more particularly to a dust collection box and a robot vacuum cleaner.

BACKGROUND

In the related art, when a robot vacuum cleaner operates, dust on the ground is sucked into a dust collection box, and air entering the dust collection box is discharged after filtered by a high efficiency particulate air (HEPA) filter while the dust is blocked by the HEPA filter and falls into the dust collection box. However, the air and dust are not separated effectively within the dust collection box, and the discharged air has poor quality and easily causes secondary pollution. In addition, the dust directly acts on the HEPA filter after entering the dust collection box, such that the service life of the HEPA filter is short, and a user needs to replace the HEPA filter frequently, which is extremely inconvenient.

SUMMARY

Embodiments of the present disclosure provide a dust collection box and a robot vacuum cleaner.

The dust collection box according to embodiments of the present disclosure includes a box body defining an air inlet and an air outlet; a filter holder arranged in the box body and defining an opening in a side surface of the filter holder; a dust separation structure configured to block dust, and arranged in the box body and located at an air inlet side of the opening; and a filter arranged to the filter holder and located at an air outlet side of the opening.

For the dust collection box according to embodiments of the present disclosure, most of the dust can be blocked by the dust separation structure, then the air enters the filter through the opening, and the air is filtered by the filter which separates air from a small amount of dust, such that the exhausted air is effectively purified. In addition, only a small amount of dust can reach the filter, so the service life of the filter is prolonged, and the user does not need to change or clean the filter 18 frequently, which brings about great convenience.

The robot vacuum cleaner according to embodiments of the present disclosure includes a robot body; and a dust collection box, arranged to the robot body. The dust collection box includes a box body defining an air inlet and an air outlet; a filter holder arranged in the box body and defining an opening in a side surface of the filter holder; a dust separation structure configured to block dust, and arranged in the box body and located at an air inlet side of the opening; and a filter arranged to the filter holder and located at an air outlet side of the opening.

For the robot vacuum cleaner according to embodiments of the present disclosure, the dust collection box can block most of the dust through the dust separation structure, then the air enters the filter via the opening, and the air is filtered by the filter which separates air from a small amount of dust, such that the exhausted air is effectively purified. In addition, only a small amount of dust can reach the filter, so the service life of the filter is prolonged, and the user does not need to change or clean the filter frequently, which brings about great convenience.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of the present disclosure will become apparent and more readily appreciated from the following descriptions of embodiments made with reference to the drawings, in which.

Figure 1:
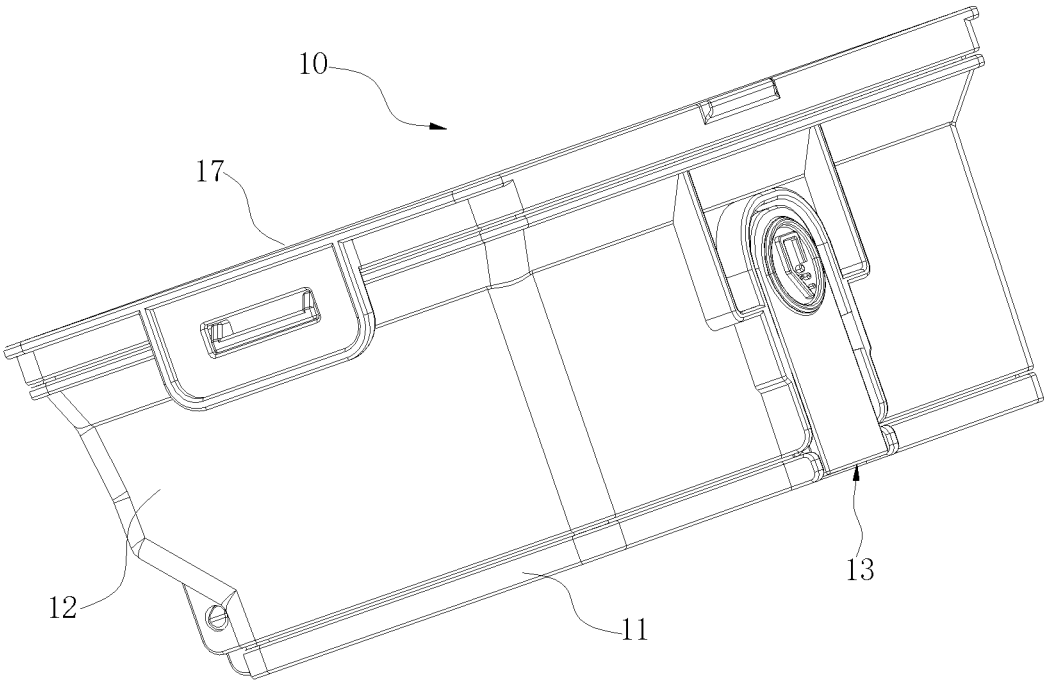
FIG. 1 is a perspective view of a dust collection box according to an embodiment of the present disclosure.

MAIN REFERENCE NUMERALS dust collection box 10, box body 12, air inlet 122, air outlet 124, dust extraction port 126, filter holder 14, opening 142, bottom plate 144, lateral plate 146, accommodating space 148, inclined surface 141, support plate 143, dust separation structure 16, filter 18, lower lid 11, first lateral portion 112, second lateral portion 114, snap structure 13, hook 132, snapping surface 1322, snapping part 134, snapping bar 1342, button 15, rotating shaft 152, press board 154, first swing end 1542, second swing end 1544, elastic member 1546, upper lid 17, sealing member 19, robot vacuum cleaner 100, robot body 20.

DETAILED DESCRIPTION

Reference will be made in detail to embodiments of the present disclosure. Examples of the embodiments are shown in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure have a particular orientation or be constructed or operated in a particular orientation. Thus, these terms cannot be constructed to limit the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

As used herein disclosure, it should be understood that, unless specified or limited otherwise, the terms "mounted," "connected," and "coupled" and variations thereof are used broadly and may be, for example, fixed connections, detachable connections, or integral connections; may also be mechanical or electrical connections; may also be direct connections or indirect connections via intervening structures; may also be inner communications or interaction of two elements, which can be understood by those skilled in the art according to specific situations.

Figure 2:
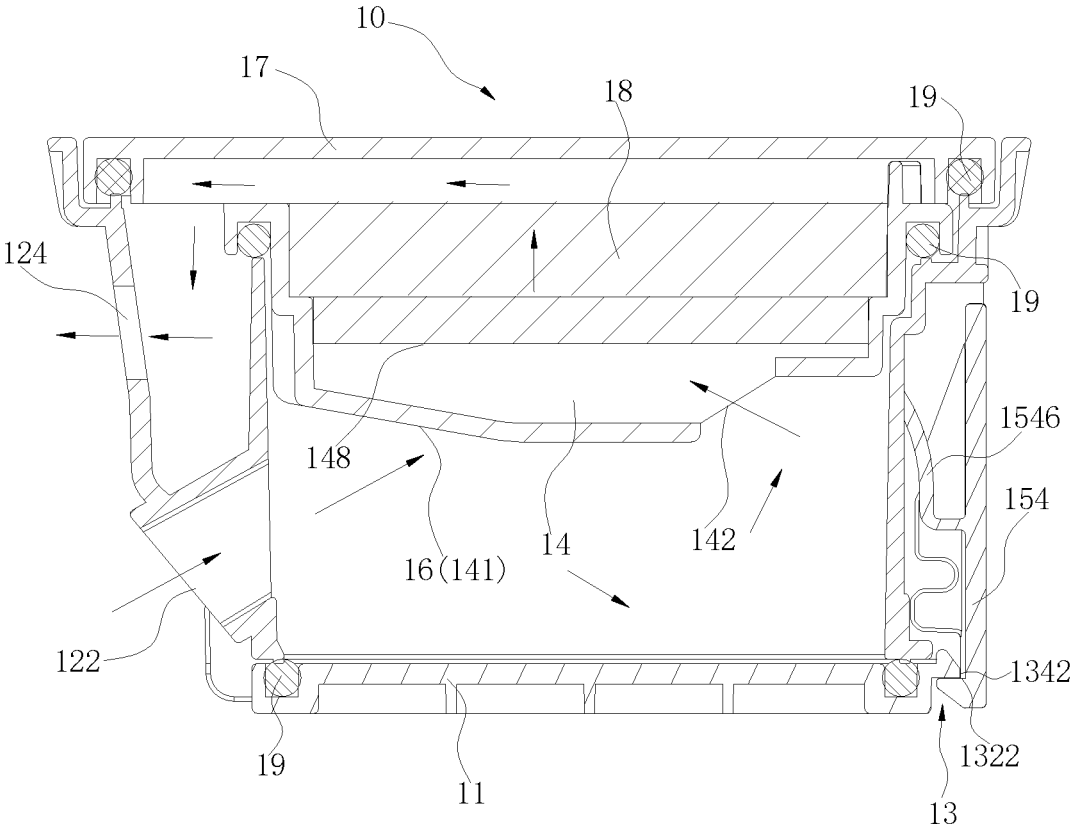
FIG. 2 is a sectional view of a dust collection box according to an embodiment of the present disclosure.
Figure 3:
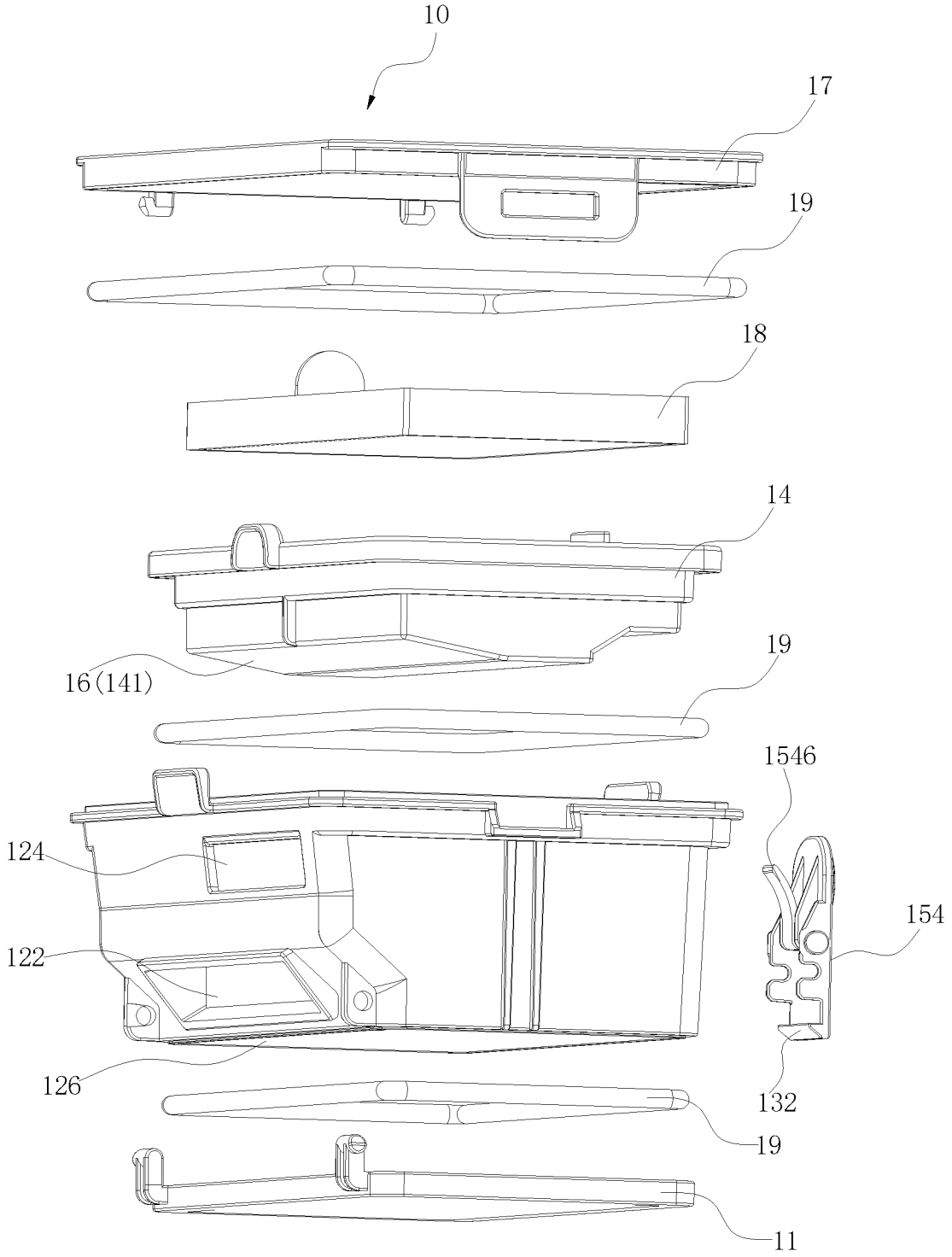
FIG. 3 is an exploded view of a dust collection box according to an embodiment of the present disclosure.
Figure 4:
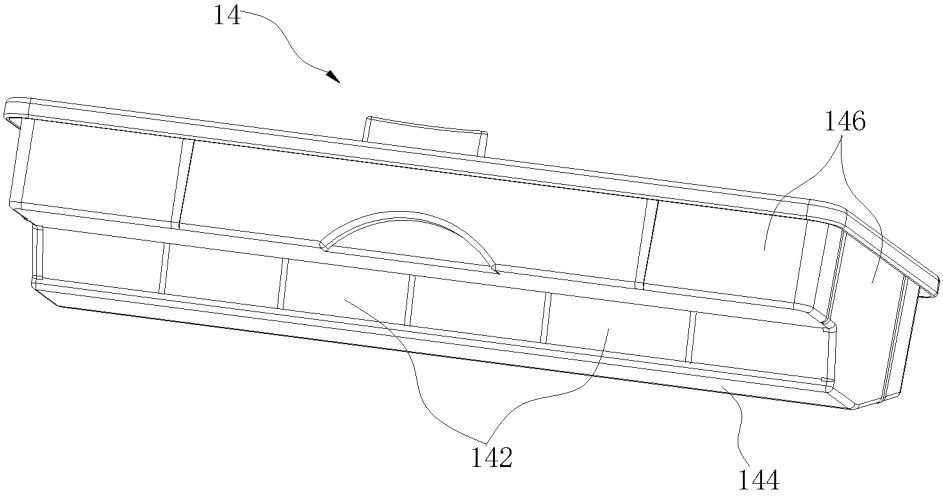
FIG. 4 is a perspective view of a filter holder according to an embodiment of the present disclosure.
Figure 5:
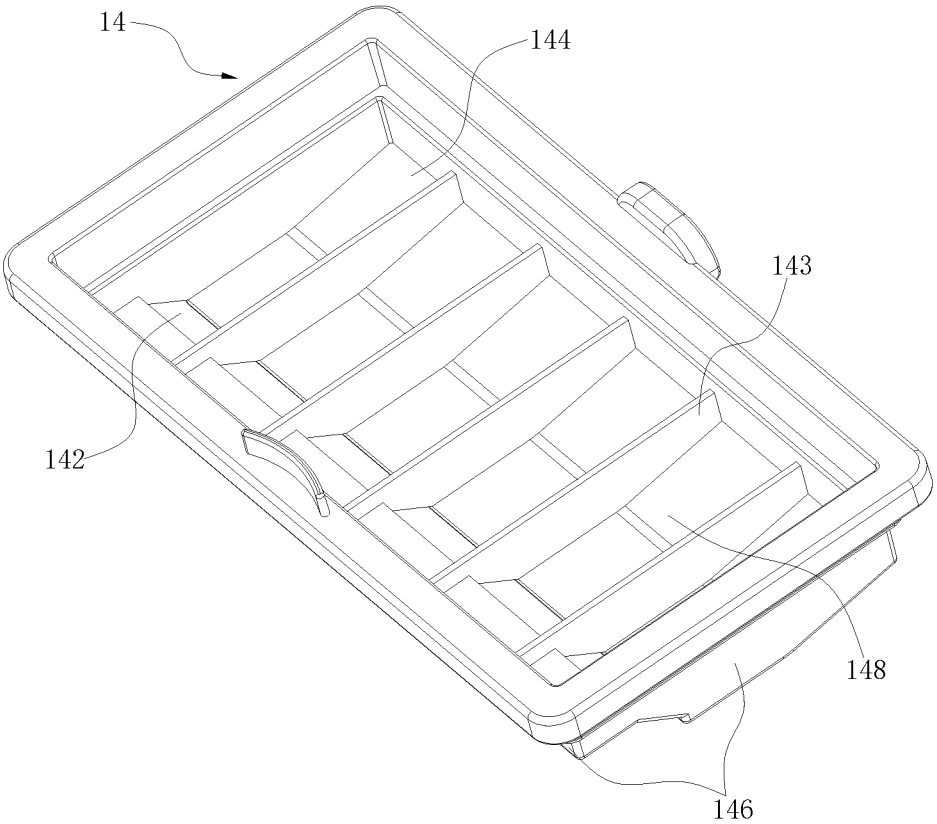
FIG. 5 is another perspective view of a filter holder according to an embodiment of the present disclosure.
Figure 6:
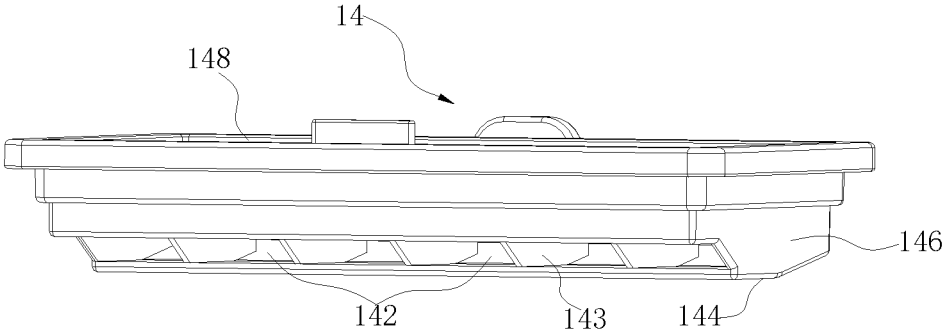
FIG. 6 is still another perspective view of a filter holder according to an embodiment of the present disclosure.
Figure 7:
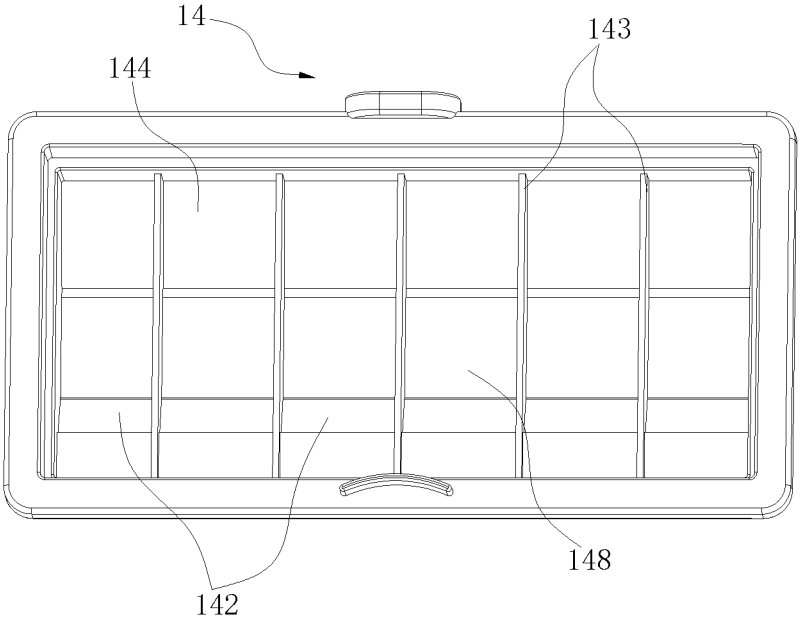
FIG. 7 is yet another perspective view of a filter holder according to an embodiment of the present disclosure.
Figure 8:
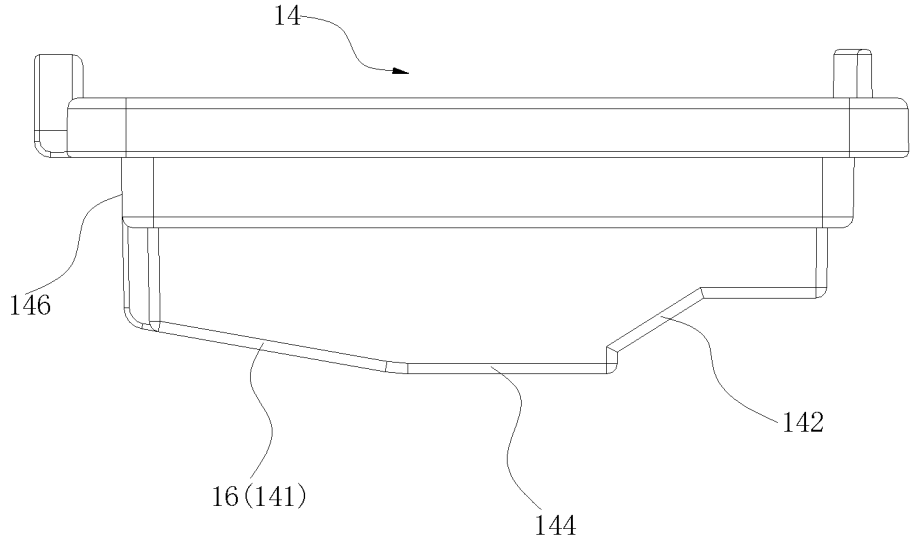
FIG. 8 is a side view of a filter holder according to an embodiment of the present disclosure.

Referring to FIGS. 1-3 together, a dust collection box 10 according to embodiments of the present disclosure is used in a robot vacuum cleaner 100. The dust collection box 10 includes a box body 12, a filter holder 14 arranged within the box body 12, a dust separation structure 16 configured to block dust, and a filter 18. The box body 12 defines an air inlet 122 and an air outlet 124. A side surface of the filter holder 14 defines an opening 142. The dust separation structure 16 is arranged within the box body 12 and located at an air inlet side of the opening 142. The filter 18 is arranged on the filter holder 14 and located at an air outlet side of the opening 142.

For the dust collection box 10 according to the present disclosure, most of the dust can be blocked by the dust separation structure 16, then the air enters the filter 18 through the opening 142, and the air is filtered by the filter 18 which separates air from a small amount of dust, such that the exhausted air is effectively purified. In addition, only a small amount of dust can reach the filter 18, so the service life of the filter 18 is prolonged, and the user does not need to change or clean the filter 18 frequently, which brings about great convenience.

It could be understood that, when the robot vacuum cleaner 100 operates, a vacuum is formed within the machine, and the dust is sucked into the box body 12 through the air inlet 122 due to an internal and external pressure difference. After the dust entrained in the air enters the box body 12, most of the dust, especially larger particles of dust are blocked by the dust separation structure 16 and falls to the bottom of the box body 12. Only a small amount of fine dust can pass through the opening 142 to the filter 18 along with the air. At this time, the dust is filtered by the filter 18, the air and the dust are effectively separated, and the exhausted air is effectively purified. By doing so, it is possible to avoid secondary pollution caused by poor air quality discharged from the dust collection box 10. In FIG. 2, a straight line with an arrow in the dust collection box 10 indicates air flow. The dust separation structure 16 is located at the air inlet side of the opening 142, that is, the dust separation structure 16 can be located anywhere before the air flow enters the opening 142. In other words, with respect to the dust separation structure 16, the opening 142 is located downstream of the air flow direction in the dust collection box 10. In such a way, it can be ensured that the air encounters the dust separation structure 16 before entering the opening 142.

In some embodiments, as shown here, the dust separation structure 16 is a bottom inclined surface 141 of the filter holder 14.

It could be understood that the dust separation structure 16 is the bottom inclined surface 141 of the filter holder 14, that is, the dust separation structure 16 is an integral part of the filter holder 14, which avoids occupying too much space of the box body 12. The dust separation structure 16 may be an inclined surface 141 facing the bottom of the box body 12, and the inclined surface 141 is opposite to the air inlet 122 and has a guiding effect on the air flow entrained with dust—making the dust fall to the bottom of the box body 12. Certainly, the dust separation structure 16 may not be an integral part of the filter holder 14, and the dust separation structure 16 may be provided in other places within the box body 12. The dust separation structure 16 may be a structural member having a guiding surface such as an inclined surface, a spherical surface, an aspheric surface, or the like.

In some embodiments, the filter 18 includes any one or more of a high efficiency particle air (HEPA) filter, a filter sponge, and an activated carbon filter sieve.

It could be understood that all of the HEPA filter, the filter sponge, and the activated carbon filter sieve can be used to filter out dust. The filter 18 may be the HEPA filter, the filter sponge, or the activated carbon filter sieve. Certainly, the filter 18 may be a combination of the HEPA filter and the filter sponge, a combination of the HEPA filter and the activated carbon filter sieve, or a combination of the filter sponge and the activated carbon filter sieve. The filter 18 may also be a combination of the HEPA filter, the filter sponge, and the activated carbon filter sieve. One filter 18 or a plurality of filters 18 can be provided, which is determined in the light of filtration requirements.

Referring to FIGS. 4-8 together, in some embodiments, the filter holder 14 includes a bottom plate 144 and a lateral plate 146. The lateral plate 146 is connected to the bottom plate 144 and defines an accommodating space 148 along with the bottom plate 144. The filter 18 is at least partially located in the accommodating space 148. The bottom plate 144 includes the inclined surface 141 opposite to the air inlet 122. The inclined surface 141 forms the dust separation structure 16, and the air inlet side of the opening 142 faces away from the air inlet 122.

It could be understood that, the fact that the inclined surface 141 being opposite to the air inlet 122 forms the dust separation structure 16 is advantageous for the dust separation structure 16 to block most of the dust entering the box body 12 along with the air, and at the same time, reduces the structural parts inside the dust collection box 10 to maximize a space for dust collection within the dust collection box 10. The air inlet side of the opening 142 faces away from the air inlet 122, and the dust separation structure 16 is located at the air inlet side of the opening 142. As a result, the opening 142 is away from the air inlet 122 as far as possible. The air flow entrained with dust passes through the dust separation structure 16 which blocks most of the dust, and then passes through the filter 18 via the opening 142, such that the filter 18 separates the air from a small amount of dust, whereby the air is further separated from the dust effectively and the exhausted air is further purified effectively.

In this embodiment, the filter 18 is substantially located in the accommodating space 148, that is, a top surface of the filter 18 is flush with a top surface of the filter holder 14, such that the overall thickness of the filter 18 and the filter holder 14 can be reduced, and the dust collection space in the dust collection box 10 can be guaranteed while the miniaturization of the dust collection box 10 is also achieved. In other embodiments, the filter 18 is partially located in the accommodating space 148, that is, the filter 18 can protrude relative to the top surface of the filter holder 14, in which embodiments, the depth of the accommodating space 148 may be designed to be relatively small, or a protruding portion of the filter 18 can also be used to position other components which are mounted on the filter 18 or the filter holder 14.

It could be understood that in order to guarantee a filtration effect, when the filter 18 is accommodated in the accommodating space 148, the filter 18 is allowed to have certain deformation to make the filter 18 be better secured to the filter holder 14. Certainly, the filter 18 can also be secured to the filter holder 14 by using an auxiliary connector such as a fastener, a screw, and the like.

In certain embodiments, the filter holder 14 includes a support plate 143. The support plate 143 is located in the accommodating space 148 and connected to the bottom plate 144 and the lateral plate 146, and the filter 18 is supported on the support plate 143.

As a result, the support plate 143 supports the filter 18, such that the filter 18 is relatively stable and less prone to offset when arranged on the filter holder 14, and more effectively filters the air flow passing through the opening 142, so as to effectively separate dust and air.

In this embodiment, a plurality of support plates 143 are provided, and the plurality of support plates 143 are spaced apart and arranged in the accommodating space 148, such that the filter 18 can be more effectively supported, and the filter 18 is prevented from being displaced due to uneven forces, which may affect the filtration effect otherwise.

Referring to FIGS. 2 and 3 again, in certain embodiments, the air inlet 122 and the air outlet 124 are provided in the same side surface of the box body 12, and the air inlet 122 is located below the air outlet 124.

As a result, when the robot vacuum cleaner 100 operates, an air flow is formed between the air inlet 122 and the air outlet 124. The dust enters the box body 12 from the air inlet 122 along with the air flow. After filtration, the dust is blocked from flowing to the air outlet 124 and instead remains in the box body 12. The filtered air is discharged through the air outlet 124. Certainly, the air inlet 122 and the air outlet 124 may be provided in different side surfaces of the box body 12. When the air inlet 122 and the air outlet 124 are provided in the same side surface of the box body 12, the air outlet 124 may be located below the air inlet 122.

Figure 9:
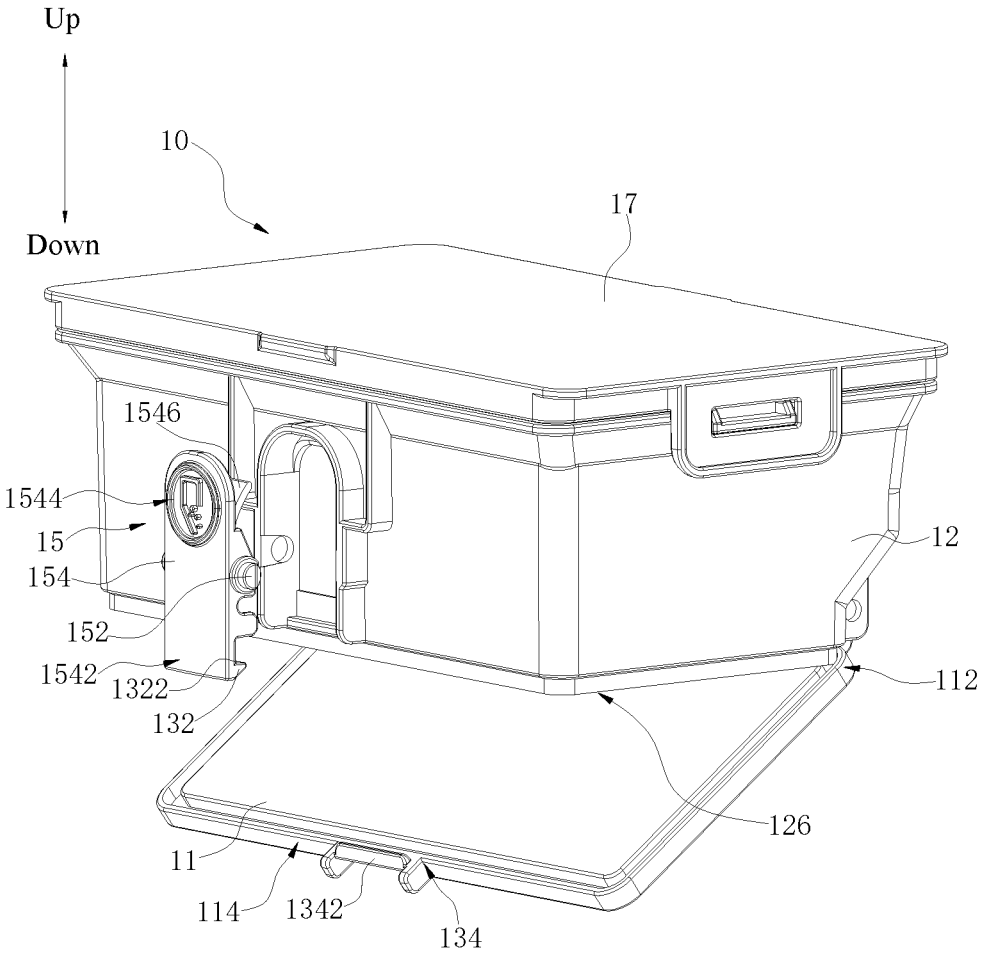
FIG. 9 is a partial exploded view of a dust collection box according to an embodiment of the present disclosure.

Referring to FIG. 9, in some embodiments, the bottom of the box body 12 defines a dust extraction port 126. The dust collection box 10 includes a lower lid 11, and the lower lid 11 is rotatably connected to the box body 12 and is used to open or close the dust extraction port 126.

It could be understood that by the lower lid 11 opening or closing the dust extraction port 126 in the bottom of the box body 12, the dust can be conveniently removed from the box body 12.

In some embodiments, the lower lid 11 includes a first lateral portion 112 and a second lateral portion 114 opposite to each other. The first lateral portion 112 is rotatably connected with the box body 12. When the lower lid 11 closes the dust extraction port 126, the second lateral portion 114 is snap-fitted with the box body 12 through a snap structure 13.

It could be understood that, the snap structure 13 makes it convenient for the lower lid 11 to open or close the dust extraction port 126. When the lower lid 11 closes the dust extraction port 126, the second lateral portion 114 can be snap-fitted with the box body 12 more reliably through the snap structure 13. Specifically, during the removal of the dust from the robot vacuum cleaner 100, the dust collection box 10 is first taken out from the robot vacuum cleaner 100, and then the snap-fit relationship between the lower lid 11 and the box body 12 is released, such that the lower lid 11 can rotate to open the dust extraction port 126 and hence the dust carried by the lower lid 11 flows out of the box body 12 along with the rotation of the lower lid 11. In such a way, it is unnecessary to take out the filter 18 and the filter holder 14 from the box body 12 during the dust removal, which facilitates the cleaning process.

Further, the first lateral portion 112 can be rotatably connected to the box body 12 in the following manner. For example, the first lateral portion 112 is provided with a rotating shaft, the box body 12 is provided with a rotating hole, and the rotating shaft is received in the rotating hole to realize the rotatable connection between the first lateral portion 112 and the box body 12.

It should be noted that a bottom direction is a downward direction illustrated in FIG. 9, and a top direction is an upward direction illustrated in FIG. 9.

In some embodiments, the dust collection box 10 includes a button 15. The button 15 includes a rotating shaft 152, and the button 15 is rotatably arranged to the box body 12 through the rotating shaft 152. The snap structure 13 includes a hook 132 formed at an end of the button 15 and a snapping part 134 formed at the second lateral portion 114. The button 15 is swingable between a first position and a second position with respect to the box body 12. In the first position, the hook 132 is snap-fitted with the snapping part 134 to make the lower lid 11 close the dust extraction port 126. In the second position, the hook 132 is disengaged from the snapping part 134 to make the lower lid 11 open the dust extraction port 126.

Thus, after the button 15 is pressed down, the hook 132 is disengaged from the snapping part 134 to make the lower lid 11 rotate to open the dust extraction port 126 to discharge the dust, which is a simple dust exhaust manner. Specifically, the hook 132 includes a snapping surface 1322 facing upwards, the snapping part 134 includes a snapping bar 1342, and in the first position, the snapping bar 1342 abuts against the snapping surface 1322, as illustrated in FIG. 2.

In certain embodiments, the button 15 includes a press board 154, and the rotating shaft 152 is fixed in a middle position of the press board 154. The press board 154 includes a first swing end 1542 and a second swing end 1544 located at two opposite sides of the rotating shaft 152 respectively. The hook 132 forms the first swing end 1542, the first swing end 1542 swings towards a direction away from the box body 12, and the second swing end 1544 swings towards a direction approaching the box body 12. The box body 12 defines a void space available for the second swing end 1544 to swing. When the first swing end 1542 swings away from the box body 12, the hook 132 is disengaged from the snapping bar 1342 and hence the lower lid 11 is opened.

As a result, the void space can prevent the button 15 from interfering with the box body 12 during the rotation.

In addition, a surface of the press board 154 opposite to the box body 12 is provided with an elastic member 1546. In a normal state, the elastic member 1546 may be or may not be in contact with a surface of the box body 12. When in contact, the elastic member 1546 may or may not generate an elastic force. When the elastic force is generated, the elastic force drives the second swing end 1544 away from the box body 12. In such a way, the snap-fitting between the hook 132 and the lower lid 11 is tightly fastened.

When the second swing end 1544 is pressed towards the box body 12 by an external force, the elastic member 1546 is compressed, and the first swing end 1542 swings away from the box body 12, such that the hook 132 is disengaged from the snapping bar 1342, and the lower lid 11 is opened. When the external force is revoked, the elastic member 1546 drives the second swing end 1544 to swing away from the box body 12, such that the first swing end 1542 is restored.

In this embodiment, the elastic member 1546 is an elastic plate on the press board 154. In other embodiments, the elastic member 1546 can be a spring, an elastic block or other elastic members.

In some embodiments, the dust collection box 10 includes an upper lid 17 detachably arranged to the top of the box body 12.

Thus, after the upper lid 17 is detached, the filter holder 14, the dust separation structure 16, the filter 18 and other elements can be taken out from or mounted into the box body 12 conveniently. Specifically, the upper lid 17 can be detachably connected with the box body 12 in a snap-fit manner, a screw connection manner, and an interference fit manner.

In some embodiments, the dust collection box 10 includes a sealing member 19, and the sealing member 19 is arranged at a joint of the components of the dust collection box 10.

It could be understood that the joint of the components in the dust collection box 10 is poorly airtight, and the sealing member 19 is provided at the joint of the components to ensure the airtightness of the dust collection box 10, so as to facilitate the vacuuming of the robot vacuum cleaner 100. The sealing member 19 can be a seal ring or a seal strip. Specifically, in the embodiments of the present disclosure, one seal ring is provided between the upper lid 17 and the top of the box body 12, one seal ring is provided between the filter holder 14 and an inner wall of the box body 12, and one ring is provided between the lower lid 11 and the bottom of the box body 12.

Figure 10:
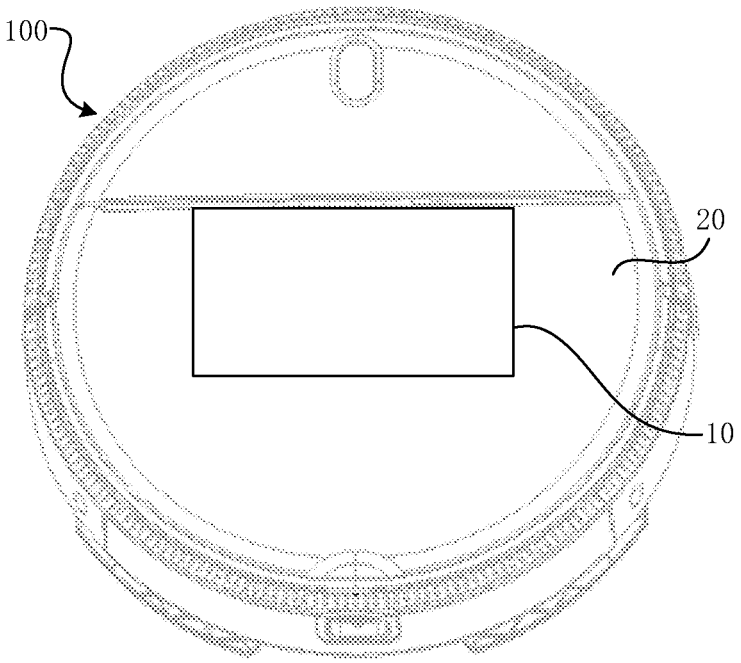
FIG. 10 is a schematic view of a robot vacuum cleaner according to an embodiment of the present disclosure.

Referring to FIG. 10, the robot vacuum cleaner 100 according to embodiments of the present disclosure includes a robot body 20 and the dust collection box 10 according to any one of the above embodiments, and the dust collection box 10 is arranged to the robot body 20.

For the robot vacuum cleaner 100 according to embodiments of the present disclosure, the dust collection box 10 can block most of the dust through the dust separation structure 16, then the air enters the filter 18 via the opening 142, and the air is filtered by the filter 18 which separates air from a small amount of dust, such that the exhausted air is effectively purified. In addition, only a small amount of dust can reach the filter 18, so the service life of the filter 18 is prolonged, and the user does not need to change or clean the filter 18 frequently, which brings about great convenience.

Preferably, the dust collection box 10 is detachably arranged to the robot body 20, for example, through a snap, a screw, an adhesive or the like.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Various embodiments and examples are provided in the following description to implement different structures of the present disclosure. In order to simplify the present disclosure, certain elements and settings are described above. However, these elements and settings are only by way of example and are not intended to limit the present disclosure. In addition, reference numerals and/or reference letters may be repeated in different examples in the present disclosure. This repetition is for the purpose of simplification and clarity, and does not refer to relations between different embodiments and/or settings. Furthermore, examples of different processes and materials are provided in the present disclosure. However, it would be appreciated by those skilled in the art that other processes and/or materials may be also applied.

Reference throughout this specification to "an embodiment," "some embodiments," "an exemplary embodiment," "an example," "specific examples" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and illustrated, it shall be understood by those skilled in the art that various changes, modifications, alternatives and variations without departing from the principle of the present disclosure are acceptable. The scope of the present disclosure is defined by the claims or the like.

What is claimed is:

1. A robot vacuum cleaner, comprising:

a robot body; and a dust collection box arranged to the robot body, and comprising:

a box body comprising an air inlet and an air outlet;

a filter holder arranged inside the box body, wherein the filter holder comprises an opening at a side surface of the filter holder, and a dust separation structure configured to block dust, wherein the dust separation structure is located at a bottom of the filter holder and opposite to the air inlet in an air path; and a filter arranged in the filter holder;

wherein the filter holder comprises a bottom plate and a lateral plate; the lateral plate is connected to the bottom plate and defines an accommodating space along with the bottom plate; and, wherein the filter is at least partially located in the accommodating space;

the bottom plate comprises an inclined surface opposite to the air inlet;

the inclined surface forms the dust separation structure; and the air inlet side of the opening faces away from the air inlet.

2. The robot vacuum cleaner according to claim 1, wherein the dust separation structure is a bottom surface of the filter holder.

3. The robot vacuum cleaner according to claim 1, wherein the filter comprises any one or more of a high efficiency particle air (HEPA) filter, a filter sponge, or an activated carbon filter sieve.

4. The robot vacuum cleaner according to claim 1, wherein the filter holder comprises a support plate, the support plate is located in the accommodating space and connected to the bottom plate and the lateral plate, and the filter is supported by the support plate.

5. The robot vacuum cleaner according to claim 1, wherein a bottom of the box body defines a dust extraction port, the dust collection box comprises a lower lid, and the lower lid is rotatably connected to the box body and used to open or close the dust extraction port.

6. The robot vacuum cleaner according to claim 5, wherein the lower lid comprises a first lateral portion and a second lateral portion opposite to each other; and, wherein the first lateral portion is rotatably connected with the box body; and when the lower lid closes the dust extraction port, the second lateral portion is snap-fitted with the box body through a snap structure.

7. The robot vacuum cleaner according to claim 6, wherein the dust collection box comprises a button, the button comprising a rotating shaft, and the button being rotatably arranged to the box body through the rotating shaft; and, wherein, the snap structure comprises a hook formed at an end of the button and a snapping part formed at the second lateral portion; and the button is swingable, with respect to the box body, between a first position where the hook is snap-fitted with the snapping part to make the lower lid close the dust extraction port and a second position where the hook is disengaged from the snapping part to make the lower lid open the dust extraction port.

8. A robot vacuum cleaner, comprising:

a robot body; and a dust collection box arranged to the robot body, and comprising:

a box body comprising an air inlet, wherein a bottom of the box body defines a dust extraction port, the dust collection box comprises a lower lid, wherein the lower lid is rotatably connected to the box body and used to open or close the dust extraction port;

a filter holder arranged inside the box body, wherein the filter holder comprises an opening at a side surface of the filter holder, a dust separation structure configured to block dust, wherein the dust separation structure is located at a bottom of the filter holder and is opposite to the air inlet, and a support plate, the support plate is located in the accommodating space and connected to the bottom plate and the lateral plate, and the filter is supported by the support plate; and a filter arranged in the filter holder.

* * * * *